US012098714B2

(12) United States Patent
Kato et al.

(10) Patent No.: US 12,098,714 B2
(45) Date of Patent: Sep. 24, 2024

(54) ELECTRIC COMPRESSOR

(71) Applicant: KABUSHIKI KAISHA TOYOTA JIDOSHOKKI, Aichi-ken (JP)

(72) Inventors: Takayuki Kato, Aichi (JP); Noritaka Nishimori, Aichi (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 270 days.

(21) Appl. No.: 17/585,091

(22) Filed: Jan. 26, 2022

(65) Prior Publication Data

US 2022/0243711 A1 Aug. 4, 2022

(30) Foreign Application Priority Data

Jan. 29, 2021 (JP) ..... 2021-013803

(51) Int. Cl.

| | |
|---|---|
| ***F04B 39/00*** | (2006.01) |
| ***F04B 35/04*** | (2006.01) |
| ***F04C 29/06*** | (2006.01) |
| ***F04D 29/66*** | (2006.01) |
| ***H02K 5/24*** | (2006.01) |

(52) U.S. Cl.

CPC ..... *F04B 39/0033* (2013.01); *F04B 35/04* (2013.01)

(58) Field of Classification Search

CPC .. F04B 39/00; F04B 39/0033; F04B 39/0027; F04B 35/04; F04C 29/06; F04C 29/066; F04C 29/063; F04D 29/663; F04D 29/664; H02K 5/24; G10K 11/16

USPC ..... 181/200, 202, 198

See application file for complete search history.

(56) References Cited

U.S. PATENT DOCUMENTS 3,455,409 A * 7/1969 Clark ..... B62D 25/2072 181/200
3,589,971 A * 6/1971 Reed ..... F16L 59/168 383/110
4,258,821 A * 3/1981 Wendt ..... F04C 29/066 181/258

(Continued)

FOREIGN PATENT DOCUMENTS

CN 205408561 U 8/2016
JP 06067678 A * 3/1994

(Continued)

*Primary Examiner* — Edgardo San Martin

(74) *Attorney, Agent, or Firm* — Greenblum & Bernstein, P.L.C.

(57) ABSTRACT

An electric compressor includes a compression part, an electric motor, an inverter, a housing that has an outer circumferential surface, and a soundproof cover that covers the outer circumferential surface of the housing. The soundproof cover has a covering portion that covers the outer circumferential surface of the housing and an overlapping portion that overlaps the covering portion in a radial direction of the housing. The overlapping portion and the covering portion each have an insertion hole. The housing is provided with a shaft that extends from the outer circumferential surface of the housing and that is inserted into the insertion hole, and a pressing part that presses a part of the overlapping portion around the insertion hole toward the housing so as to elastically deform the overlapping portion and the covering portion. The soundproof cover is attached to the housing with the shaft and the pressing part.

7 Claims, 5 Drawing Sheets

(56) References Cited

U.S. PATENT DOCUMENTS

| | | | | | |
|---|---|---|---|---|---|
| 5,169,025 | A * | 12/1992 | Guo | B65D 81/3876 | 215/393 |
| 5,272,285 | A * | 12/1993 | Miller | F01C 21/10 | 181/202 |
| 5,274,200 | A * | 12/1993 | Das | E04B 1/8218 | 415/119 |
| 5,293,010 | A * | 3/1994 | Archambault | G10K 9/22 | 181/198 |
| 5,588,810 | A * | 12/1996 | DiFlora | F04B 39/0033 | 181/403 |
| 6,932,190 | B2 * | 8/2005 | Sishtla | F16L 55/0336 | 181/290 |
| 7,357,219 | B2 * | 4/2008 | Mafi | F24F 13/24 | 181/290 |
| 7,963,363 | B2 * | 6/2011 | Niwa | B60R 13/0838 | 181/290 |
| 9,273,683 | B2 * | 3/2016 | Yokoi | F04B 39/12 | |
| 9,413,204 | B2 * | 8/2016 | Ota | F04B 17/03 | |
| 10,418,014 | B2 * | 9/2019 | Lowry | G10K 11/162 | |
| 11,480,174 | B2 * | 10/2022 | Nalini | F04C 18/0215 | |
| 11,715,993 | B2 * | 8/2023 | Nishimori | B32B 5/18 | 310/51 |
| 2012/0251357 | A1 | 10/2012 | Yokoi et al. | | |
| 2016/0265523 | A1 * | 9/2016 | Kinoshita | F04C 28/28 | |
| 2022/0170484 | A1 * | 6/2022 | Watanabe | F04C 29/066 | |
| 2022/0307506 | A1 * | 9/2022 | Nishimori | F04B 39/121 | |

FOREIGN PATENT DOCUMENTS

| | | | | |
|---|---|---|---|---|
| JP | 2012-202377 | A | | 10/2012 |
| JP | 2013194673 | A | * | 9/2013 |
| KR | 101838077 | B1 | * | 3/2018 |

* cited by examiner

ELECTRIC COMPRESSOR

CROSS-REFERENCE TO RELATED APPLICATION

This application claims priority to Japanese Patent Application No. 2021-013803 filed on Jan. 29, 2021, the entire disclosure of which is incorporated herein by reference.

BACKGROUND ART

The present disclosure relates to an electric compressor.

An electric compressor includes a compression part configured to compress fluid, an electric motor configured to drive the compression part, and an inverter configured to drive the electric motor. In such an electric compressor, sound may be generated by an operation of the compression part and by a driving of the electric motor. In an electric compressor, for example, as disclosed in Japanese Patent Application Publication No. 2012-202377, a soundproof cover entirely covers an outer circumferential surface of a housing. Accordingly, even when the sound generated by the operation of the compression part and by the driving of the electric motor is radiated as radiated sound emitted from the housing, such radiated sound is absorbed by the soundproof cover. As a result, noise of the electric compressor can be reduced.

However, when the soundproof cover is made from a sound absorbing material that is elastically deformable, such sound absorbing material is flexible and the soundproof cover easily moves relative to the housing due to vibration and the like. Then, the soundproof cover may be removed from the housing. When the soundproof cover is removed from the housing, it is hard for the soundproof cover to absorb the radiated sound emitted from the housing. This causes difficulty in reducing the noise of the electric compressor.

SUMMARY

In accordance with an aspect of the present disclosure, there is provided an electric compressor that includes a compression part configured to compress fluid, an electric motor configured to drive the compression part, an inverter configured to drive the electric motor, a housing that has an outer circumferential surface having a cylindrical shape and accommodates the compression part, the electric motor, and the inverter, and a soundproof cover that is made from a sound absorbing material being elastically deformable, the soundproof cover covering the outer circumferential surface of the housing, wherein the soundproof cover has a covering portion that covers the outer circumferential surface of the housing and an overlapping portion that overlaps the covering portion in a radial direction of the housing, wherein the overlapping portion and the covering portion each have an insertion hole. The housing is provided with a shaft that extends from the outer circumferential surface of the housing and that is inserted into the insertion hole and a pressing part that presses a part of the overlapping portion around the insertion hole toward the housing so as to elastically deform the overlapping portion and the covering portion. The soundproof cover is attached to the housing with the shaft and the pressing part.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
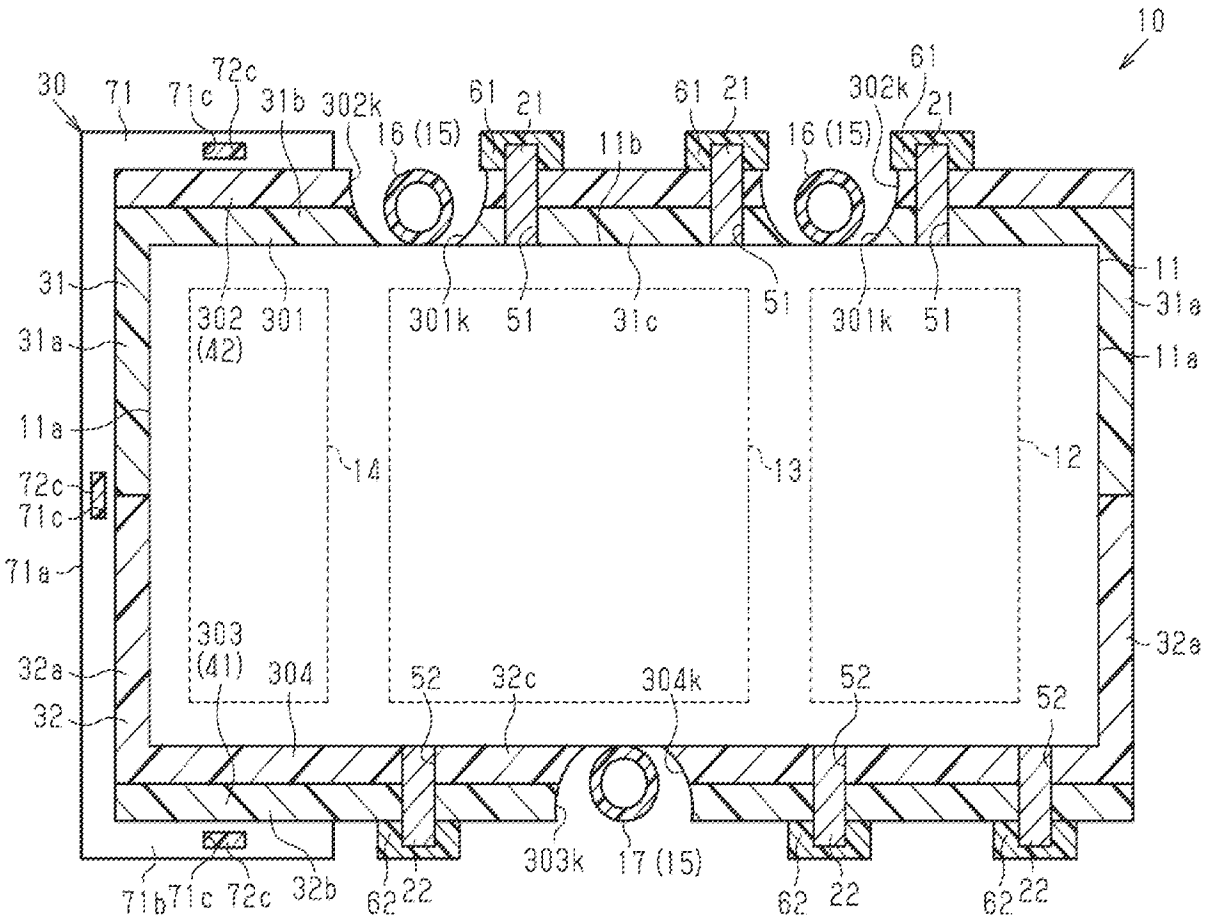
FIG. 1 is a schematic sectional view of an electric compressor according to an embodiment.
Figure 2:
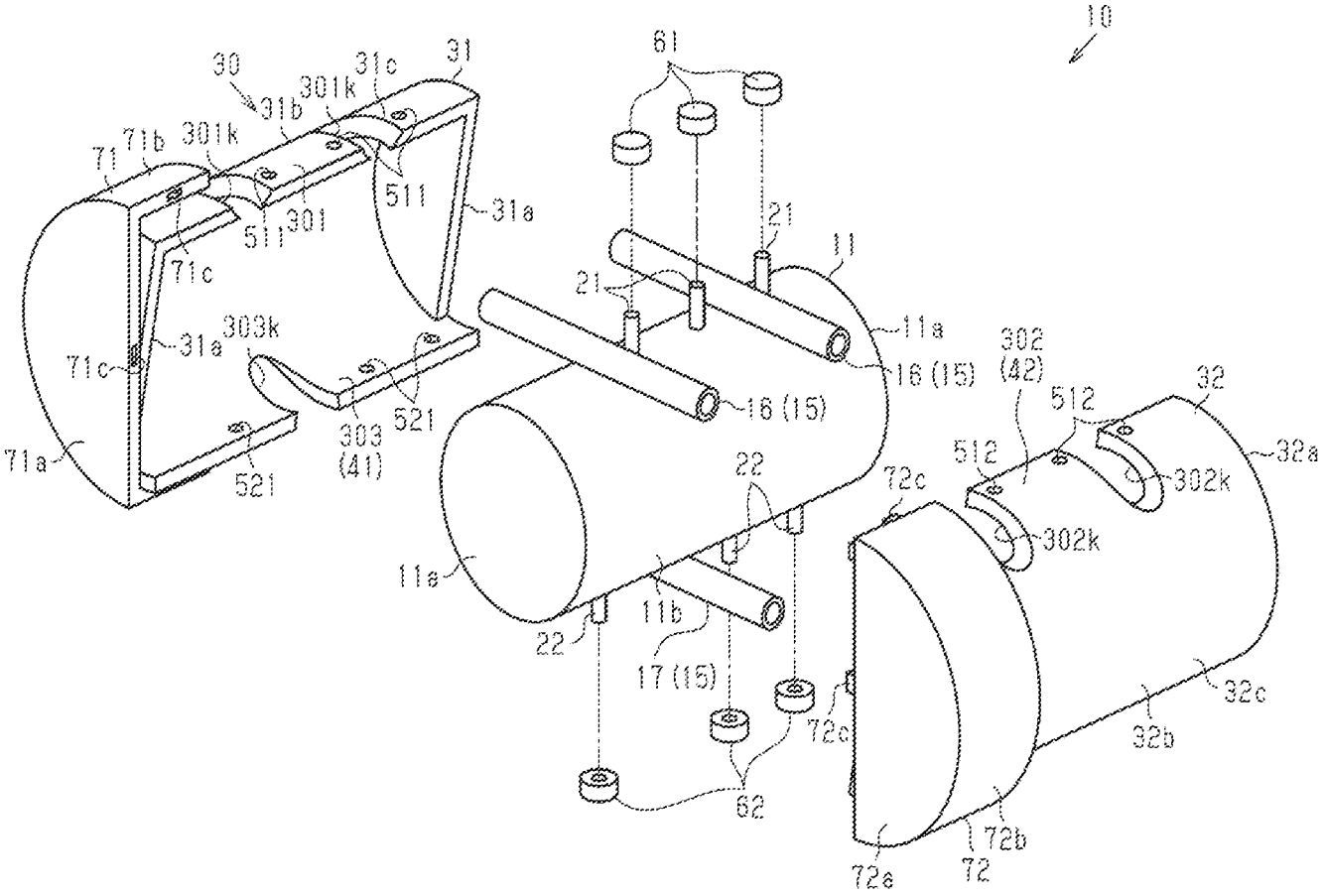
FIG. 2 is an exploded perspective view of the electric compressor.

Hereinafter, an embodiment of an electric compressor will be described with reference to FIG. 1 to FIG. 3. The electric compressor of the present embodiment is used for a vehicle air conditioner, for example. As illustrated in FIG. 1 and FIG. 2, an electric compressor 10 includes a housing 11. The housing 11 has a cylindrical shape. The housing 11 is made of a metal material such as aluminum. The housing 11 has a pair of end walls 11*a* each having a plate-like shape, a circumferential wall 11*b* having a cylindrical shape that connects the pair of end walls 11*a*. Thus, the housing 11 has an outer circumferential surface of the circumferential wall 11*b* having the cylindrical shape.

As illustrated in FIG. 1, the electric compressor 10 includes a compression part 12 configured to compress a refrigerant as fluid, an electric motor 13 configured to drive the compression part 12, and an inverter 14 configured to drive the electric motor 13. The housing 11 accommodates the compression part 12, the electric motor 13, and the inverter 14 that are arranged in this order along an axial direction of the housing 11.

The compression part 12 is, for example, a scroll type compression part including a fixed scroll fixed to an inner circumferential surface of the circumferential wall 11*b* of the housing 11 and a movable scroll disposed so as to face the fixed scroll. The electric motor 13 is driven by receiving power supplied from the inverter 14. The compression part 12 compresses the refrigerant drawn into the housing 11 along with a drive of the electric motor 13.

As illustrated in FIG. 2, the electric compressor 10 has a plurality of mounting legs 15. In the present embodiment, the electric compressor 10 has three mounting legs 15. The three mounting legs 15 are provided on the outer circumferential surface of the circumferential wall 11*b* of the housing 11. Each of the three mounting legs 15 has a cylindrical shape. Two of the three mounting legs 15 correspond to first mounting legs 16 that are disposed on one side of the housing 11 across its axis, in a radial direction of the housing 11. The remaining one of the three mounting legs 15 corresponds to a second mounting leg 17 that is disposed on the other side of the housing 11 across its axis. The first mounting legs 16 and the second mounting leg 17 extend in a direction orthogonal to the axial direction of the housing 11. The first mounting legs 16 and the second mounting leg 17 extend in the same direction. For example, the electric compressor 10 is mounted to a vehicle body with bolts (not illustrated) that are respectively inserted through the first mounting legs 16 and the second mounting leg 17 and that are respectively screwed into target portions of the vehicle body to be mounted.

The electric compressor 10 has a plurality of first shafts 21 and a plurality of second shafts 22, each serving as a shaft. The first shafts 21 and the second shafts 22 extend from the outer circumferential surface of the circumferential wall 11*b* of the housing 11. The first shafts 21 and the second shafts 22 are each integrally formed with the housing 11. Therefore, the first shafts 21 and the second shafts 22 are provided in the housing 11. The first shafts 21 and the second shafts 22 each have a columnar shape. The first shafts 21 are disposed on the one side of the housing 11 across its axis. The second shafts 22 are disposed on the other side of the housing 11 across its axis.

The first shafts 21 protrude from portions on the outer circumferential surface of the circumferential wall 11*b* of the housing 11, in which the first shafts 21 and the first mounting legs 16 overlap each other as viewed in the axial direction of the housing 11. The first shafts 21 are arranged side by side at intervals along the axial direction of the housing 11. The first shafts 21 extend in the direction orthogonal to the axial direction of the housing 11, also in a direction orthogonal to an extending direction of each of the first mounting legs 16.

The second shafts 22 protrude from portions on the outer circumferential surface of the circumferential wall 11*b* of the housing 11, in which the second shafts 22 and the second mounting leg 17 overlap each other as viewed in the axial direction of the housing 11. The second shafts 22 are arranged side by side at intervals along the axial direction of the housing 11. The second shafts 22 extend in the direction orthogonal to the axial direction of the housing 11, also in a direction orthogonal to an extending direction of the second mounting leg 17. A direction in which the second shafts 22 protrude from the outer circumferential surface of the circumferential wall 11*b* of the housing 11 is opposite to a direction in which the first shafts 21 protrude from the outer circumferential surface of the circumferential wall 11*b* of the housing 11.

The electric compressor 10 includes a soundproof cover 30 that entirely covers the outer circumferential surface of the housing 11. The soundproof cover has a first cover component 31 and a second cover component 32. The first cover component 31 and the second cover component 32 are made from sound absorbing materials that have sound absorbing properties and that are elastically deformable. The first cover component 31 and the second cover component 32 are made of open-cell foamed urethane resins, for example. Thus, the first cover component 31 and the second cover component 32 are made from flexible materials. Therefore, the soundproof cover 30 is made from at least the sound absorbing materials that are elastically deformable.

The first cover component 31 has a semi-cylindrical shape. The first cover component 31 has a pair of first end walls 31*a* each having a plate-like shape and a first circumferential wall 31*b* having a semi-cylindrical shape that connects the pair of first end walls 31*a* therebetween. The first cover component 31 is disposed relative to the housing 11 such that the first circumferential wall 31*b* covers a part of the circumferential wall 11*b* of the housing 11 and such that each first end wall 31*a* covers a part of the corresponding end wall 11*a* of the housing 11. Therefore, an extending direction of the first circumferential wall 31*b* of the first cover component 31 corresponds to a circumferential direction of the housing 11.

The second cover component 32 has a semi-cylindrical shape. The second cover component 32 has a pair of second end walls 32*a* each having a plate-like shape and a second circumferential wall 32*b* having a semi-cylindrical shape that connects the pair of second end walls 32*a* therebetween. The second cover component 32 is disposed relative to the housing 11 such that the second circumferential wall 32*b* covers a remaining part of the circumferential wall 11*b* of the housing 11, the remaining part being not covered by the first circumferential wall 31*b* of the first cover component 31. Therefore, an extending direction of the second circumferential wall 32*b* of the second cover component 32 corresponds to the circumferential direction of the housing 11. The second cover component 32 is also disposed relative to the housing 11 such that each of the second end walls 32*a* covers a remaining part of the corresponding end wall 11*a* of the housing 11, the remaining part being not covered by each of the first end walls 31*a* of the first cover component 31.

Figure 3:
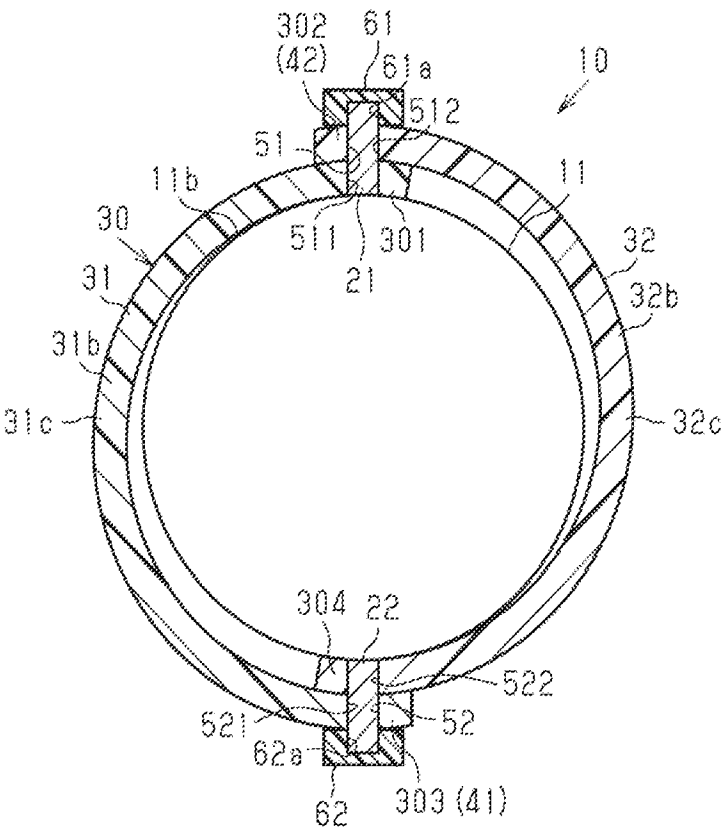
FIG. 3 is a schematic sectional view of the electric compressor.

As illustrated in FIG. 3, the first cover component 31 has a first end portion 301 on one of opposite ends of the first circumferential wall 31*b* along its circumferential direction, and the second cover component 32 has a second end portion 302 on one of opposite ends of the second circumferential wall 32*b* along its circumferential direction. The first end portion 301 and the second end portion 302 overlap each other in the radial direction of the housing 11. The first cover component 31 has a third end portion 303 on the other of the opposite ends of the first circumferential wall 31*b* along its circumferential direction, and the second cover component 32 has a fourth end portion 304 on the other of the opposite ends of the second circumferential wall 32*b* along its circumferential direction. The third end portion 303 and the fourth end portion 304 overlap each other in the radial direction of the housing 11. The outer circumferential surface of the housing 11 is entirely covered with the first circumferential wall 31*b* of the first cover component 31 and the second circumferential wall 32*b* of the second cover component 32. Therefore, the soundproof cover 30 of the present embodiment has a structure of combination of the first cover component 31 and the second cover component 32 that each have a halved cylindrical shape.

Specifically, the first cover component 31 has a first covering portion 31*c* as a covering portion that covers a part of the outer circumferential surface of the housing 11. The second cover component 32 has a second covering portion 32*c* as the covering portion that covers a part of the outer circumferential surface of the housing 11.

The third end portion 303 of the first cover component 31 corresponds to a first overlapping portion 41 as an overlapping portion that overlaps the second covering portion 32*c* of the second cover component 32 in the radial direction of the housing 11. The first overlapping portion 41 overlaps the fourth end portion 304 of the second circumferential wall 32*b* of the second cover component 32, radially outward of the housing 11. The first covering portion 31*c* of the first cover component 31 corresponds to a part of the first cover component 31 except for the third end portion 303 of the first circumferential wall 31*b*.

The second end portion 302 of the second cover component 32 corresponds to a second overlapping portion 42 as an overlapping portion that overlaps the first covering portion 31*c* of the first cover component 31 in the radial direction of the housing 11. The second overlapping portion 42 overlaps the first end portion 301 of the first circumferential wall 31*b* of the first cover component 31, radially outward of the housing 11. The second covering portion 32*c* of the second cover component 32 corresponds to a part of the second cover component 32 except for the second end portion 302 of the second circumferential wall 32*b*.

Three first holes 511 are formed through the first end portion 301 of the first cover component 31. Three first holes 512 are formed through the second end portion 302 of the second cover component 32. The first holes 511 of the first cover component 31 are each connected to the first holes 512 of the second cover component 32, which form first insertion holes 51, each serving as an insertion hole. That is, the first end portion 301 of the first cover component 31 has the first holes 511, and the second end portion 302 of the second cover component 32 has the first holes 512. Each of the first holes 511 and the corresponding first hole 512 are connected to each other, which forms each of the first insertion holes 51. Accordingly, the second overlapping portion 42 and the first covering portion 31*c* each have one of the first insertion holes 51 into which each of the first shafts 21 is inserted.

Three second holes 521 are formed through the third end portion 303 of the first cover component 31. Three second holes 522 are formed through the fourth end portion 304 of the second cover component 32. The second holes 521 of the first cover component 31 are each connected to the second holes 522 of the second cover component 32, which form second insertion holes 52, each serving as an insertion hole. That is, the third end portion 303 of the first cover component 31 has the second holes 521, and the fourth end portion 304 of the second cover component 32 has the second holes 522. Each of the second holes 521 and the corresponding second hole 522 are connected to each other, which forms each of the second insertion holes 52. Accordingly, the first overlapping portion 41 and the second covering portion 32*c* each have one of the second insertion holes 52 into which each of the second shafts 22 is inserted.

With the first shafts 21 each inserted into the first insertion holes 51, ends of the first shafts 21 opposite to the housing 11 project from the first overlapping portion 41. With the second shafts 22 inserted into the second insertion holes 52, ends of the second shafts 22 opposite to the housing 11 project from the second overlapping portion 42.

The electric compressor 10 includes a plurality of first pressing parts 61 and a plurality of second pressing parts 62, each serving as a pressing part. The first pressing parts 61 are attached to the ends of the first shafts 21 opposite to the housing 11. Thus, the housing 11 has the first pressing parts 61 with the first shafts 21. The second pressing parts 62 are attached to the ends of the second shafts 22 opposite to the housing 11. Thus, the housing 11 has the second pressing parts 62 with the second shafts 22. The first pressing parts 61 and the second pressing parts 62 are disc-shaped fasteners. The first pressing parts 61 and the second pressing parts 62 are made of resins, for example.

Each of the first pressing parts 61 has a fitting recess 61*a* into which the end of the corresponding first shaft 21 opposite to the housing 11 is fitted. The fitting recess 61*a* has a circular-concaved shape. Each of the second pressing parts 62 has a fitting recess 62*a* into which the end of the corresponding second shaft 22 opposite to the housing 11 is fitted. The fitting recess 62*a* has a circular-concaved shape.

As illustrated in FIG. 1 and FIG. 2, the first end portion 301 of the first cover component 31 has two first cutouts 301*k*. The two first cutouts 301*k* are formed in the first end portion 301 of the first cover component 31 so as to avoid the first mounting legs 16. The third end portion 303 of the first cover component 31 has one second cutout 303*k*. The second cutout 303*k* is formed in the third end portion 303 of the first cover component 31 so as to avoid the second mounting leg 17.

The second end portion 302 of the second cover component 32 has two first cutouts 302*k*. The two first cutouts 302*k* are formed in the second end portion 302 of the second cover component 32 so as to avoid the first mounting legs 16. The fourth end portion 304 of the second cover component 32 has one second cutout 304*k*. The second cutout 304*k* is formed in the fourth end portion 304 of the second cover component 32 so as to avoid the second mounting leg 17.

As illustrated in FIG. 1, the first end portion 301 of the first cover component 31 and the second end portion 302 of the second cover component 32 are positioned such that the first cutouts 301*k* of the first cover component 31 and the first cutouts 302*k* of the second cover component 32 overlap each other. The third end portion 303 of the first cover component 31 and the fourth end portion 304 of the second cover component 32 are positioned such that the second cutout 303*k* of the first cover component 31 and the second cutout 304*k* of the second cover component 32 overlap each other.

As illustrated in FIG. 1 and FIG. 2, the soundproof cover 30 has a first sound-insulating member 71 and a second sound-insulating member 72. The first sound-insulating member 71 and the second sound-insulating member 72 are harder than the first cover component 31 and the second cover component 32. The first sound-insulating member 71 and the second sound-insulating member 72 are sound-insulating sheets made of vinyl chloride resin, polyolefin resin, or the like.

The first sound-insulating member 71 has a first sound-insulating end wall 71*a* and a first sound-insulating circumferential wall 71*b*. The first sound-insulating end wall 71*a* covers one of the pair of first end walls 31*a* of the first cover component 31. The first sound-insulating circumferential wall 71*b* covers a part of the first circumferential wall 31*b* of the first cover component 31, specifically the part adjacent to the one of the pair of first end walls 31*a*.

The second sound-insulating member 72 has a second sound-insulating end wall 72*a* and a second sound-insulating circumferential wall 72*b*. The second sound-insulating end wall 72*a* covers one of the pair of second end walls 32*a* of the second cover component 32. The second sound-insulating circumferential wall 72*b* covers a part of the second circumferential wall 32*b* of the second cover component 32, specifically the part of the one of the pair of second end walls 32*a*.

The first sound-insulating member 71 has a plurality of engaging recesses 71*c*. The second sound-insulating member 72 has a plurality of engaging protrusions 72*c* that is respectively engaged with the engaging recesses 71*c*. The first sound-insulating member 71 and the second sound-insulating member 72 are engaged with each other by engagement of each of the engaging protrusions 72*c* with the corresponding engaging recess 71*c*.

As illustrated in FIG. 3, the first pressing parts 61 each press a part of the second overlapping portion 42 around the first insertion holes 51 toward the housing 11, which elastically deforms the second overlapping portion 42 and the first covering portion 31*c*. Thus, the soundproof cover 30 is held between the first pressing parts 61 and the housing 11. Specifically, the first shafts 21 are fitted one-to-one into fitting recesses 61*a* of the first pressing parts 61; accordingly, the part of the second overlapping portion 42 around the first insertion holes 51 and a part of the first covering portion 31*c* around the first insertion holes 51 are held between the first pressing parts 61 and the outer circumferential surface of the housing 11.

The second pressing parts 62 each press a part of the first overlapping portion 41 around the second insertion holes 52 toward the housing 11, which elastically deforms the first overlapping portion 41 and the second covering portion 32*c*. Thus, the soundproof cover 30 is held between the second pressing parts 62 and the housing 11. Specifically, the second shafts 22 are fitted one-to-one into the fitting recesses 62*a* of the second pressing parts 62; accordingly, the part of the first overlapping portion 41 around the second insertion holes 52 and a part of the second covering portion 32*c* around the second insertion holes 52 are held between the second pressing parts 62 and the outer circumferential surface of the housing 11. As a result, the soundproof cover 30 is attached to the housing 11. Therefore, the soundproof cover 30 is attached to the housing 11 with the first shafts 21, the first pressing parts 61, the second shafts 22, and the second pressing parts 62.

Next, operations of the present embodiment will be described. Sound generated by an operation of the compression part 12 and sound generated by a driving of the electric motor 13 are emitted from the housing 11. At this time, such radiated sound emitted from the housing 11 is absorbed by the first cover component 31 and the second cover component 32 of the soundproof cover 30, which reduces noise of the electric compressor 10. The first sound-insulating member 71 and the second sound-insulating member 72 block the sound that leaks from the first cover component 31 and the second cover component 32, which prevents the sound from being further radiated outward.

The first pressing parts 61 each press the part of the second overlapping portion 42 around the first insertion holes 51 toward the housing 11, which elastically deforms the second overlapping portion 42 and the first covering portion 31*c*. Thus, the soundproof cover 30 is held between the first pressing parts 61 and the housing 11. The second pressing parts 62 each press a part of the first overlapping portion 41 around the second insertion holes 52 toward the housing 11, which elastically deforms the first overlapping portion 41 and the second covering portion 32*c*. Thus, the soundproof cover 30 is held between the second pressing parts 62 and the housing 11. As described above, the soundproof cover 30 is attached to the housing 11; therefore, the soundproof cover 30 hardly moves relative to the housing 11.

In the above-described embodiment, the following effects can be obtained.

(1) The first pressing parts 61 each press the part of the second overlapping portion 42 around the first insertion holes 51 toward the housing 11, which elastically deforms the second overlapping portion 42 and the first covering portion 31*c*. Thus, the soundproof cover 30 is held between the first pressing parts 61 and the housing 11. The second pressing parts 62 each press the part of the first overlapping portion 41 around the second insertion holes 52 toward the housing 11, which elastically deforms the first overlapping portion 41 and the second covering portion 32*c*. Thus, the soundproof cover 30 is held between the second pressing parts 62 and the housing 11. For this reason, the soundproof cover 30 hardly moves relative to the housing 11. This can avoid the problem in which the soundproof cover 30 moves relative to the housing 11 due to vibration or the like, thereby being removed from the housing 11. As a result, even when the sound generated by the operation of the compression part 12 and the sound generated by the driving of the electric motor 13 are radiated as the radiated sound emitted from the housing 11, such radiated sound can be absorbed by the soundproof cover 30. This can reduce the noise of the electric compressor 10.

(2) The first shafts 21 and the second shafts 22 are integrally formed with the housing 11. Each of the first pressing parts 61 has the fitting recess 61*a* into which the end of the corresponding first shaft 21 opposite to the housing 11 is fitted. Each of the second pressing parts 62 has the fitting recess 62*a* into which the end of the corresponding second shaft 22 opposite to the housing 11 is fitted. The above-described configuration is a suitable configuration for holding the soundproof cover 30 between the housing 11 and the first pressing parts 61 and the second pressing parts 62 by pressing the part of the second overlapping portion 42 around the first insertion holes 51 toward the housing 11 thereby elastically deforming the second overlapping portion 42 and the first covering portion 31*c*, and by pressing the part of the first overlapping portion 41 around the second insertion holes 52 toward the housing 11 thereby elastically deforming the first overlapping portion 41 and the second covering portion 32*c*.

(3) The soundproof cover 30 that has the first cover component 31 and the second cover component 32 is suitable as a configuration of the soundproof cover 30 that covers the outer circumferential surface of the housing 11.

(4) Since the soundproof cover 30 hardly moves relative to the housing 11, the soundproof cover 30 hardly slides relative to the housing 11, for example. This can avoid the problem in which abrasion of the soundproof cover 30 due to its sliding relative to the housing 11 causes the thickness of the soundproof cover 30 to be thinner. Therefore, a decrease in sound absorption performance of the soundproof cover 30 can be prevented.

(5) In the soundproof cover 30, a portion where the first overlapping portion 41 overlaps the second covering portion 32*c* and a portion where the second overlapping portion 42 overlaps the first covering portion 31*c* are thicker than other portions. This can improve sound absorption performance of the soundproof cover 30 as compared with the soundproof cover 30 having an even thickness.

The above-described embodiment can be modified and implemented as follows. The above-described embodiment and the following modified embodiments can be implemented in combination with each other to the extent that there is no technical contradiction.

Figure 4:
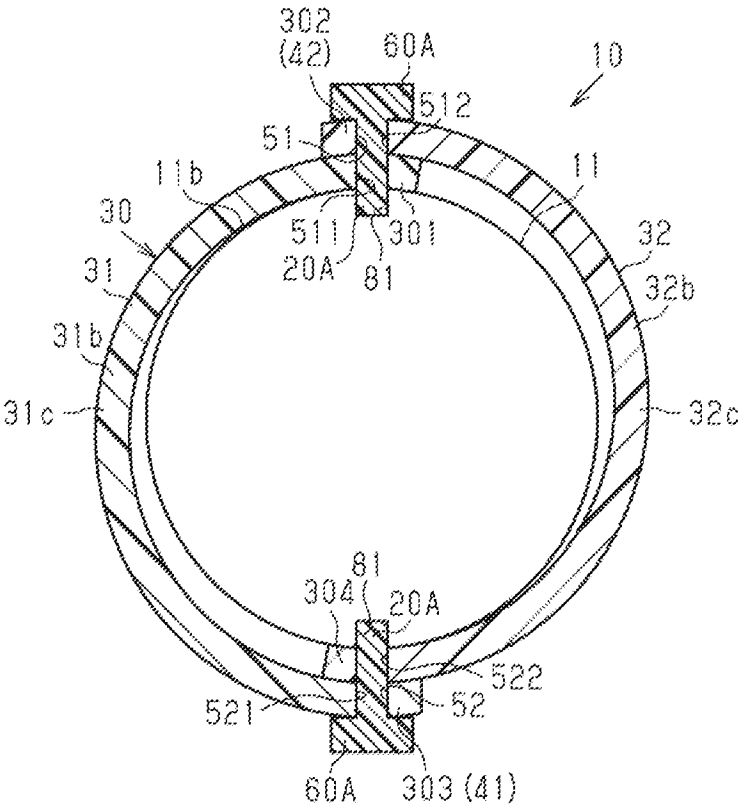
FIG. 4 is a schematic sectional view of an electric compressor according to a modified embodiment.

As illustrated in FIG. 4, the housing 11 may have mounting recesses 81 into which shafts 20A are respectively mounted, the shafts 20A being integrally formed with pressing parts 60A. Each of the mounting recesses 81 has a circular-concaved shape. The mounting recesses 81 receive ends of the shafts 20A opposite to the pressing parts 60A, which allows the shafts 20A to be mounted to the mounting recesses 81. Therefore, even when the shafts 20A and the pressing parts 60A are integrally formed with each other, the shafts 20A are provided in the housing 11 and extend from the outer circumferential surface of the housing 11. The shafts 20A are mounted to the mounting recesses 81; accordingly, a part of the second overlapping portion 42 around the first insertion holes 51 and a part of the first covering portion 31*c* around the first insertion holes 51 are held between the pressing parts 60A and the outer circumferential surface of the housing 11. As described above, a configuration in which the housing 11 has the mounting recesses 81 receiving the shafts 20A integrally formed with the pressing parts 60A is a suitable configuration for holding the soundproof cover 30 between the housing 11 and the pressing parts 60A by pressing the part of the second overlapping portion 42 around the first insertion holes 51 toward the housing 11 thereby elastically deforming the second overlapping portion 42 and the first covering portion 31*c*, and by pressing the part of the first overlapping portion 41 around the second insertion holes 52 toward the housing 11 thereby elastically deforming the first overlapping portion 41 and the second covering portion 32*c*.

In an embodiment illustrated in FIG. 4, a bolt may be screwed into each of the mounting recesses 81 which is a female screw hole, for example. In this case, a head of the bolt corresponds to each of the pressing parts 60A and a shaft of the bolt corresponds to each of the shafts 20A.

Figure 5:
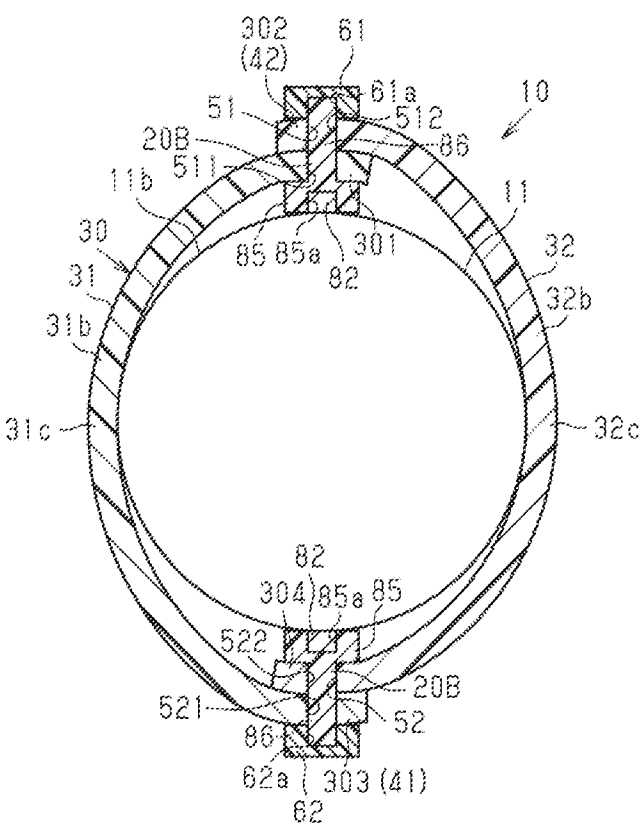
FIG. 5 is a schematic sectional view of an electric compressor according to another modified embodiment.

As illustrated in FIG. 5, for example, shafts 20B each inserted into the corresponding first insertion hole 51 need not be integrally formed with the housing 11. The shafts 20B are members provided separately from the housing 11. The housing 11 has mounting protrusions 82. The mounting protrusions 82 protrude from the outer circumferential surface of the housing 11. The shafts 20B each have a seat portion 85 having a plate-like shape and an insertion part 86 having a columnar shape. The insertion part 86 protrudes from one end surface of the seat portion 85 in its thickness direction. The seat portion 85 has a recess 85*a*. The recess 85*a* into which each of the mounting protrusions 82 is fitted is formed on the other end surface of the seat portion 85 in its thickness direction. Each of the mounting protrusion 82 is fitted into the recess 85*a*, which allows the shafts 20B to be mounted to each of the mounting protrusion 82. Therefore, even when the shafts 20B are not integrally formed with the housing 11, the shafts 20B are provided in the housing 11 and extend from the outer circumferential surface of the housing 11. For example, fitting recesses 61*a* of the first pressing parts 61 are respectively fitted into the insertion part 86 of each of the shafts 20B; accordingly, a part of the second overlapping portion 42 around each of the first insertion hole 51 and a part of the first covering portion 31*c* around each of the first insertion holes 51 are held with the corresponding first pressing part 61 and the seat portion 85.

Figure 6:
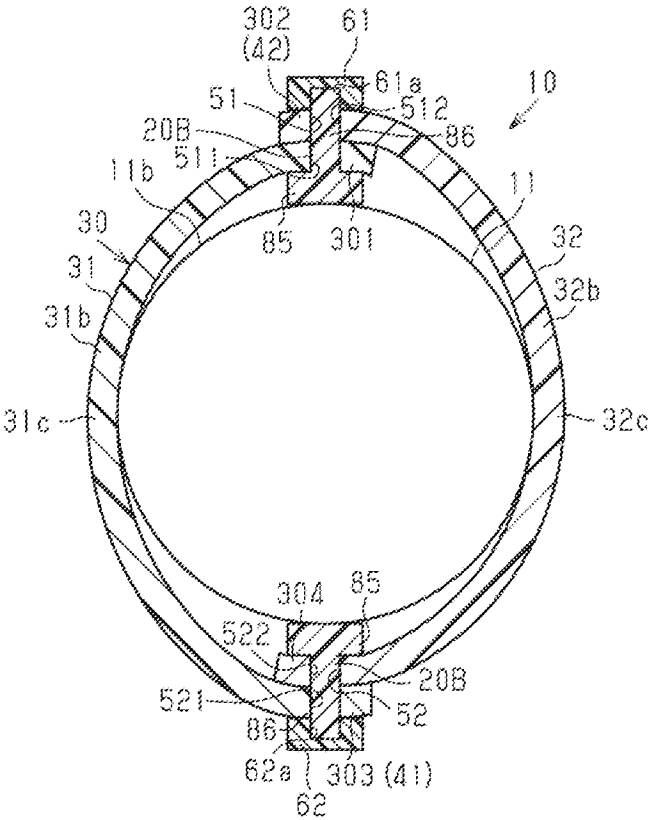
FIG. 6 is a schematic sectional view of an electric compressor according to another modified embodiment.

As illustrated in FIG. 6, the shafts 20B may be bonded, for example, with an adhesive, to the outer circumferential surface of the housing 11 in a condition in which the mounting protrusions 82 as illustrated in the modified embodiment illustrated in FIG. 5 do not protrude from the outer circumferential surface of the housing 11.

Figure 7:
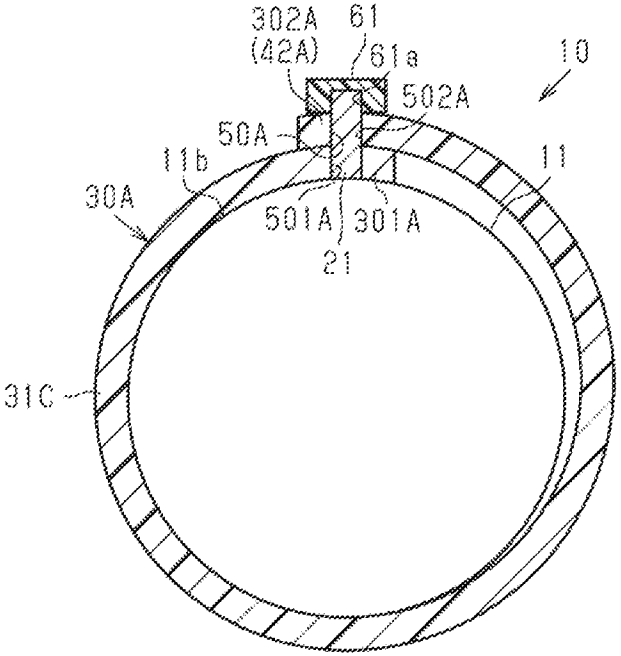
FIG. 7 is a schematic sectional view of an electric compressor according to another modified embodiment.

As illustrated in FIG. 7, the soundproof cover 30A may be a single member that is seamless from a first end portion 301A to a second end portion 302A along the circumferential direction of the housing 11. The first end portion 301A is positioned on one of opposite ends of the soundproof cover 30A along the circumferential direction of the housing 11. The second end portion 302A is positioned on the other of the opposite ends of the soundproof cover 30A along the circumferential direction of the housing 11. The first end portion 301A and the second end portion 302A overlap each other.

The second end portion 302A of the soundproof cover 30A serves as an overlapping portion 42A that overlaps a covering portion 31C of the soundproof cover 30A in the radial direction of the housing 11. The overlapping portion 42A overlaps the first end portion 301A of the soundproof cover 30A, radially outward of the housing 11. The covering portion 31C of the soundproof cover 30A is a portion of the soundproof cover 30A except for the second end portion 302A.

The first end portion 301A of the soundproof cover 30A has first holes 501A each forming an insertion hole 50A, and the second end portion 302A of the soundproof cover 30A has second holes 502A each connected to the corresponding first hole 501A to form the insertion hole 50A.

The first shafts 21 are fitted into the fitting recesses 61*a* of the first pressing parts 61; accordingly, a part of the overlapping portion 42A around the insertion holes 50A and a part of the covering portion 31C around the insertion holes 50A are held with the first pressing parts 61 and the outer circumferential surface of the housing 11. Thus, the soundproof cover 30A is attached to the housing 11. A configuration of the soundproof cover 30A as the single member that is seamless from the first end portion 301A to the second end portion 302A along the circumferential direction of the housing 11 is a suitable configuration of the soundproof cover 30A that covers the outer circumferential surface of the housing 11.

In the present modified embodiment as illustrated in FIG. 7, one of the first end portion 301A and the second end portion 302A only need serve as the overlapping portion 42A.

Figure 8:
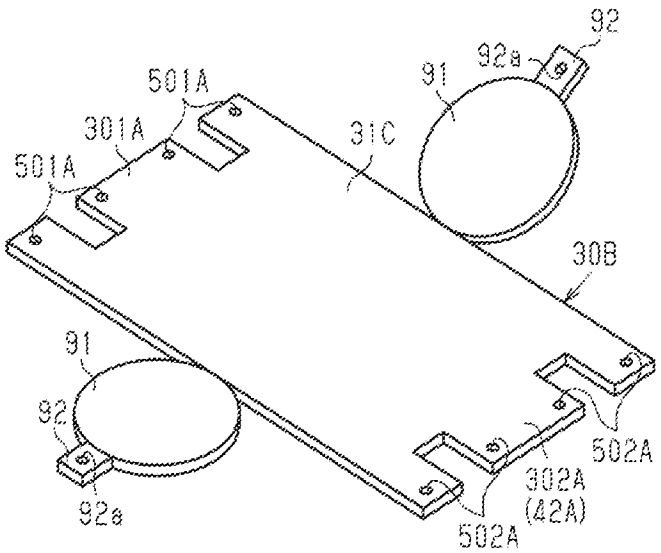
FIG. 8 is a developed perspective view of a soundproof cover according to another modified embodiment.

As illustrated in FIG. 8, when the soundproof cover 30B is a seamless single member as illustrated in the modified embodiment illustrated in FIG. 7, a pair of cover portions 91 that entirely covers the end walls 11*a* of the housing 11 may be integrally formed with the soundproof cover 30B. The cover portions 91 may each have an extension 92 that overlaps a part of the overlapping portion 42A. The extension 92 has a connecting hole 92*a* connecting to the corresponding insertion hole 50A of the overlapping portion 42A. For example, the fitting recesses 61*a* of the first pressing parts 61 receive the first shafts 21 inserted into the insertion holes 50A and the connecting holes 92*a*; accordingly, the extensions 92 may be attached to the housing 11 and be held between the first pressing parts 61 and the housing 11, while being elastically deformed, together with the overlapping portion 42A and the covering portion 31C.

In a modified embodiment illustrated in FIG. 8, each of the cover portions 91 may be formed separately from the single seamless member in the modified embodiment as illustrated in FIG. 7. For example, each of the cover portions 91 may be bonded to the corresponding end wall 11*a* of the housing 11 with the adhesive or the like.

In the above-described embodiments, one of the first end portion 301 and the second end portion 302 only need serve as the overlapping portion.

In the above-described embodiment and modifications, one of the third end portion 303 and the fourth end portion 304 only need serve as the overlapping portion.

In the above-described embodiments, the soundproof cover 30 need not have the first sound-insulating member 71 and the second sound-insulating member 72. In short, the soundproof cover 30 is simply required to be made from at least a sound absorbing material being elastically deformable.

In the above-described embodiments, the first pressing parts 61 and the second pressing parts 62 may be made of rubber, for example.

The number of mounting legs 15 is not limited to that in the above-described embodiments.

In the above-described embodiments, the compression part 12 is not limited to a scroll type compression part and, for example, may be a piston type or vane type compression part.

In the above-described embodiments, the electric compressor 10 is used for the vehicle air conditioner, but is applicable to other uses. For example, the electric compressor 10 may be mounted on a fuel cell vehicle and may compress air as fluid supplied to fuel cells by using the compression part 12.

What is claimed is:

1. An electric compressor comprising:

a compression part configured to compress fluid;

an electric motor configured to drive the compression part;

an inverter configured to drive the electric motor;

a housing that has an outer circumferential surface having a cylindrical shape, the housing accommodating the compression part, the electric motor, and the inverter; and a soundproof cover that is made from a sound absorbing material being elastically deformable, the soundproof cover covering the outer circumferential surface of the housing, wherein the soundproof cover has:

a covering portion that covers the outer circumferential surface of the housing; and an overlapping portion that overlaps the covering portion in a radial direction of the housing, wherein the overlapping portion and the covering portion each have an insertion hole, the housing is provided with: a shaft that extends from the outer circumferential surface of the housing and that is inserted into the insertion hole; and a pressing part that presses a part of the overlapping portion around the insertion hole toward the housing to elastically deform the overlapping portion and the covering portion, and the soundproof cover is attached to the housing with the shaft and the pressing part.

2. The electric compressor according to claim 1, wherein the shaft is integrally formed with the housing, the pressing part has a fitting recess into which an end of the shaft opposite to the housing is fitted, and the part of the overlapping portion around the insertion hole is pressed toward the housing with the shaft fitted into the fitting recess of the pressing part.

3. The electric compressor according to claim 1, wherein the shaft and the pressing part are integrally formed with each other, the housing has a mounting recess into which the shaft is mounted, and the part of the overlapping portion around the insertion hole is pressed toward the housing with the shaft mounted into the mounting recess.

4. The electric compressor according to claim 1, wherein the soundproof cover has a first cover component and a second cover component, the first cover component has a first end portion on one of opposite ends of the first cover component along a circumferential direction of the housing, the second cover component has a second end portion on one of opposite ends of the second cover component along the circumferential direction of the housing, one of the first end portion and the second end portion serves as the overlapping portion with the first end portion and the second end portion overlapped each other in the radial direction of the housing, the first end portion and the second end portion each have a first insertion hole as the insertion hole, the first cover component has a third end portion on the other of the opposite ends of the first cover component along the circumferential direction of the housing, the second cover component has a fourth end portion on the other of the opposite ends of the second cover component along the circumferential direction of the housing, one of the third end portion and the fourth end portion serves as the overlapping portion with the third end portion and the fourth end portion overlapped each other in the radial direction of the housing, and the third end portion and the fourth end portion each have a second insertion hole as the insertion hole.

5. The electric compressor according to claim 1, wherein the soundproof cover has a first end portion on one of opposite ends of the soundproof cover along the circumferential direction of the housing and a second end portion on the other of the opposite ends of the soundproof cover along the circumferential direction of the housing, one of the first end portion and the second end portion serves as the overlapping portion with the first end portion and the second end portion overlapped each other in the radial direction of the housing, the first end portion and the second end portion each have the insertion hole, and the soundproof cover is a single member that is seamless from the first end portion to the second end portion along the circumferential direction of the housing.

6. The electric compressor according to claim 1, wherein the shaft is provided separately from the housing, the housing has a mounting protrusion that protrudes from the outer circumferential surface of the housing, the shaft has a recess into which the mounting protrusion is fitted, and the mounting protrusion is fitted into the recess of the shaft.

7. The electric compressor according to claim 1, wherein the shaft is provided separately from the housing, and the shaft is bonded and attached to the housing with an adhesive.

* * * * *